US010530094B2

(12) United States Patent
Furuya et al.

(10) Patent No.: US 10,530,094 B2
(45) Date of Patent: Jan. 7, 2020

(54) ELECTRICAL CONNECTOR

(71) Applicant: Tyco Electronics Japan G.K., Kanagawa (JP)

(72) Inventors: Sumiyoshi Furuya, Kanagawa (JP); Hiroki Kondo, Kanagawa (JP); Shinji Amemiya, Kanagawa (JP); Fumito Nagashima, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 15/942,959

(22) Filed: Apr. 2, 2018

(65) Prior Publication Data

US 2018/0287296 A1 Oct. 4, 2018

(30) Foreign Application Priority Data

Apr. 3, 2017 (JP) ..... 2017-073438

(51) Int. Cl.
*H01R 13/625* (2006.01)
*H01R 13/629* (2006.01)
*H01R 13/6583* (2011.01)

(52) U.S. Cl.
CPC . *H01R 13/62916* (2013.01); *H01R 13/62911* (2013.01); *H01R 13/6583* (2013.01)

(58) Field of Classification Search
CPC ..... H01R 13/62916; H01R 13/6583; H01R 13/62911
USPC ..... 439/347, 157
See application file for complete search history.

(56) References Cited

U.S. PATENT DOCUMENTS 4,407,042 A * 10/1983 Schramme ..... H02B 1/044 16/2.1
5,458,496 A * 10/1995 Itou ..... B60L 53/65 439/34
5,928,013 A * 7/1999 Iwahori ..... H01R 13/62905 439/157

(Continued)

FOREIGN PATENT DOCUMENTS

JP 8-335477 A 12/1996
JP 10-289760 A 10/1998

(Continued)

OTHER PUBLICATIONS

Extended European Search Report, European Patent Application No. 18165204.1, dated Jul. 26, 2018, 8 pages.
Abstract of JP 2015-069835, dated Apr. 13, 2015, 1 page.

*Primary Examiner* — Abdullah A Riyami
*Assistant Examiner* — Nelson R. Burgos-Guntin
(74) *Attorney, Agent, or Firm* — Barley Snyder

(57) ABSTRACT

An electrical connector comprises a housing configured to be mated with a mating connector along a mating direction, a shell made of a metal material and enclosing the housing, and a slide cam made of a metal material and slidable with respect to the housing and the shell in a sliding direction perpendicular to the mating direction. The slide cam has a cam portion guiding the mating connector along the mating direction, a first elastic portion configured to be pressed against a metal region of the mating connector, and a second elastic portion integrally formed in a single piece with the cam portion and the first elastic portion and configured to be pressed against a predetermined region of the shell.

20 Claims, 7 Drawing Sheets

(56) References Cited

U.S. PATENT DOCUMENTS 6,017,236 A * 1/2000 Yoshida ..... H01R 13/62905 439/347
6,045,375 A * 4/2000 Aoki ..... H01R 13/62905 439/157
6,254,407 B1 * 7/2001 Burns ..... H01R 13/62905 439/157
6,273,756 B1 8/2001 Ward et al.
6,595,790 B1 * 7/2003 Bigotto ..... H01R 13/62905 439/157
7,329,138 B2 * 2/2008 Van Der Mee .. H01R 13/62927 439/347
7,918,675 B2 * 4/2011 Van Den Meersschaut ..... H01R 13/62911 439/157
2002/0173184 A1 * 11/2002 Miyazaki ..... H01R 13/62933 439/157
2003/0216072 A1 11/2003 Kato et al.
2004/0121640 A1 * 6/2004 Okamoto ..... H01R 13/62911 439/347
2006/0223371 A1 10/2006 Van Der Mee et al.
2009/0286430 A1 11/2009 Van Den Meersschaut et al.
2011/0223793 A1 * 9/2011 Bischoff ..... H01R 13/4362 439/347
2012/0100753 A1 * 4/2012 Omae ..... H01R 13/5202 439/588
2012/0244737 A1 * 9/2012 Becavin ..... H01R 13/6395 439/347
2013/0045618 A1 * 2/2013 Sen ..... H01R 13/639 439/347
2014/0017925 A1 * 1/2014 Shiga ..... H01R 13/62 439/347
2015/0031228 A1 * 1/2015 Oh ..... H01R 4/48 439/347
2015/0222055 A1 * 8/2015 Plazio ..... H01R 13/639 439/347
2016/0322746 A1 * 11/2016 Sasaki ..... H01R 13/62955
2018/0287296 A1 * 10/2018 Furuya ..... H01R 13/6583

FOREIGN PATENT DOCUMENTS

JP 2000-353574 A 12/2000
JP 4475185 B2 3/2010
JP 2014-165098 A 9/2014
JP 2015-069835 A 4/2015

* cited by examiner

ELECTRICAL CONNECTOR

CROSS-REFERENCE TO RELATED APPLICATION

This application claims the benefit of the filing date under 35 U.S.C. § 119(a)-(d) of Japanese Patent Application No. 2017-073438, filed on Apr. 3, 2017.

FIELD OF THE INVENTION

The present invention relates to an electrical connector and, more particularly, to an electrical connector having a shell for electromagnetic shielding.

BACKGROUND

In order to reduce or eliminate the emission of electromagnetic noise outward from a piece of equipment, and to reduce the effect of electromagnetic noise from another piece of equipment, an electrical connector has a shell for electromagnetic shielding. Such an electrical connector is disclosed in Japanese Patent Application No. 2014-165098 A, in which a spring member made of metal is positioned between the shell made of metal, the shell enclosing a housing of the connector, and a metal member of a mating object. When the connector is mated, the shell and the metal member of the mating object are electrically connected via the spring member, which is radially elastically deformed.

In order to ensure that the shell and the metal member of the mating object come into contact with each other via the spring member, the spring member must be formed from a metal material having elasticity. A metal material used for the shell, by contrast, generally does not have good elasticity properties. Therefore, it is necessary to manufacture the spring member separately from the shell, and consequently, the presence of such a spring member causes the number of components of the electrical connector to be increased accordingly. The manufacturing cost of the electrical connector, including the cost required for assembly, is correspondingly high. In addition, the spring force of the spring member resists a force with which the connector is inserted into the mating object, and therefore the matability of the connector is impaired.

SUMMARY

An electrical connector comprises a housing configured to be mated with a mating connector along a mating direction, a shell made of a metal material and enclosing the housing, and a slide cam made of a metal material and slidable with respect to the housing and the shell in a sliding direction perpendicular to the mating direction. The slide cam has a cam portion guiding the mating connector along the mating direction, a first elastic portion configured to be pressed against a metal region of the mating connector, and a second elastic portion integrally formed in a single piece with the cam portion and the first elastic portion and configured to be pressed against a predetermined region of the shell.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
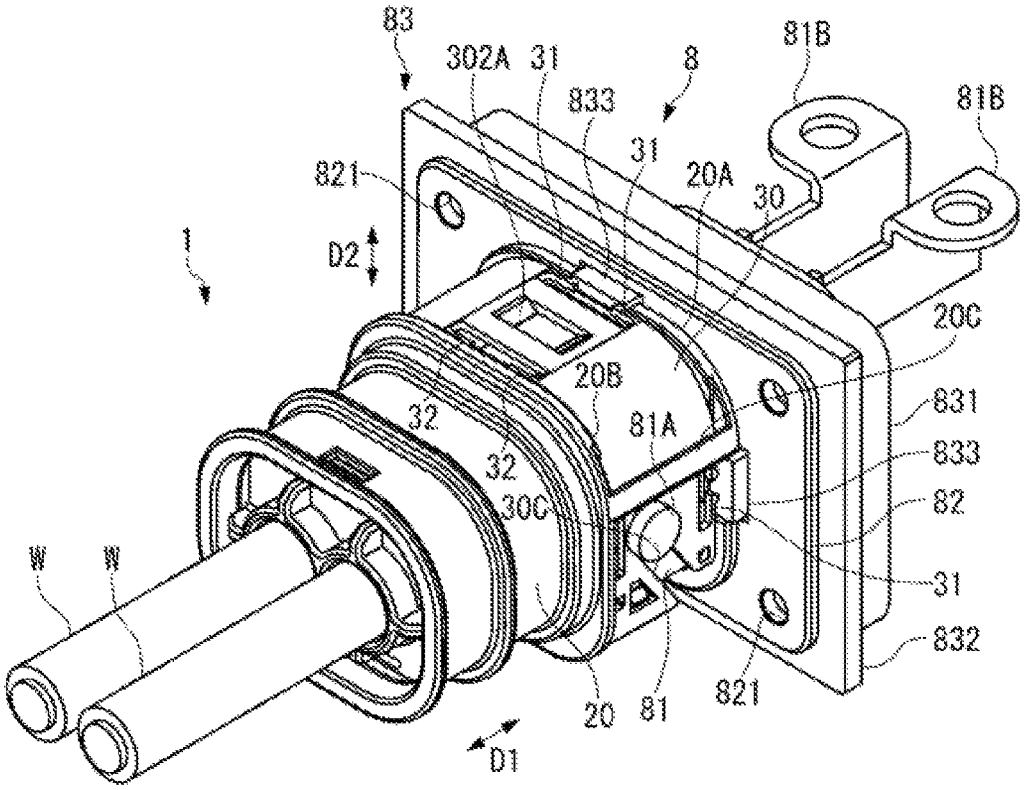
FIG. 1 is a perspective view of an electrical connector according to an embodiment with a mating connector.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

An electrical connector 1 according to an embodiment is shown in FIG. 1 mated with a mating connector 8. The mating connector 8 is disposed in a case of a device. Throughout the description, a side of the electrical connector 1 mated along a mating direction D1 with the mating connector 8 is defined as "front", and the opposite side is defined as "rear". In an embodiment, the electrical connector 1 and the mating connector 8 are used for electrical connection of high voltage equipment, such as a PCU (Power Control Unit), installed on a vehicle. In order to reduce or eliminate the emission of electromagnetic noise outward from the equipment and/or the effect of electromagnetic noise from another piece of equipment, the electrical connector 1 and the mating connector 8 have an electromagnetic shielding.

Figure 2:
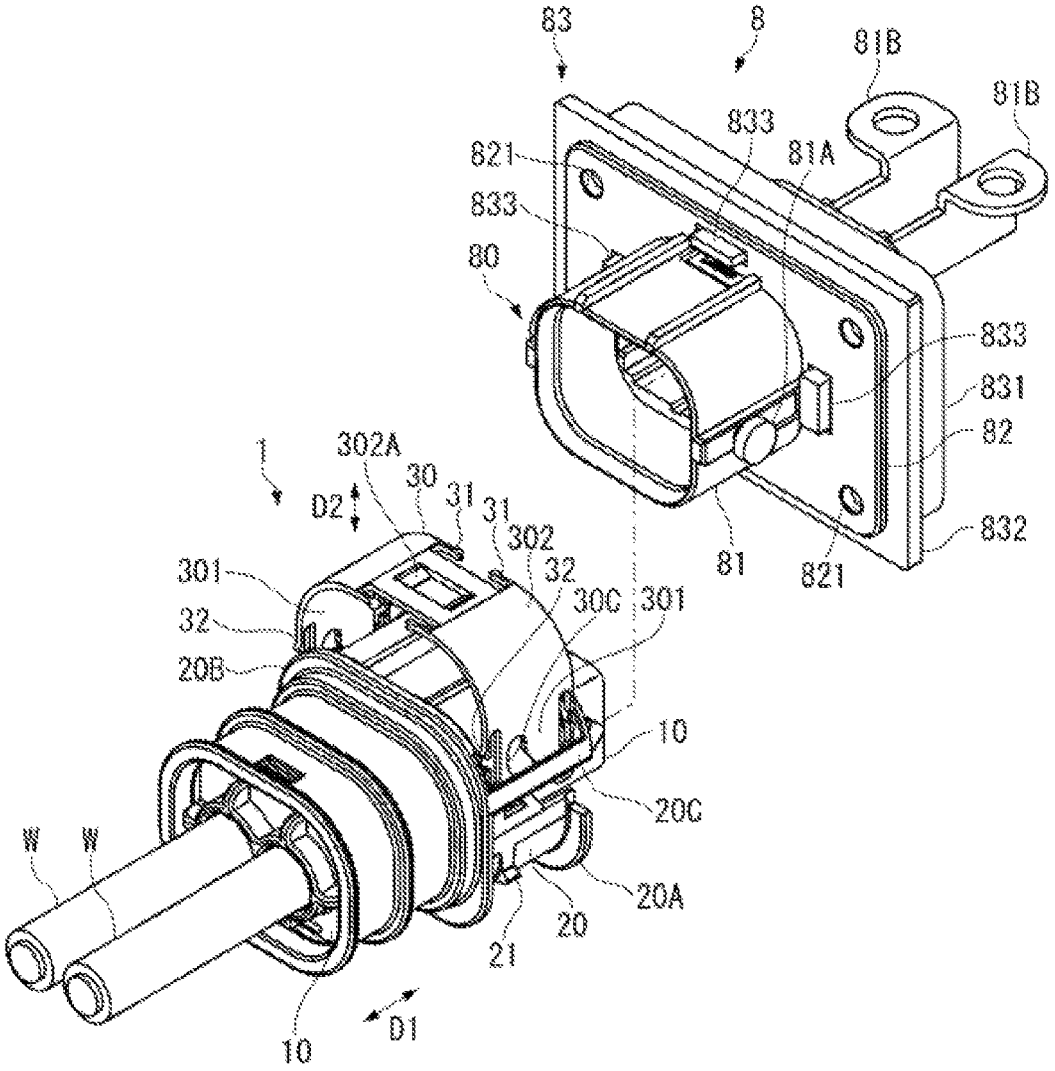
FIG. 2 is a perspective view of the electrical connector and the mating connector separated from each other.

As shown in FIGS. 1 and 2, the electrical connector 1 has a housing 10, a shell 20 for electromagnetic shielding provided on the housing 10, and a slide cam 30 made of metal and slidable with respect to the housing 10 and the shell 20. In the shown embodiment, the electrical connector 1 is a plug connector.

The mating connector 8, as shown in FIGS. 1 and 2, has a mating housing 80 retaining a mating contact and a connection member 83 made of metal and supporting the mating housing 80. When mated with the electrical connector 1, the mating housing 80 receives the housing 10 therein. In the shown embodiment, the mating connector 8 is a receptacle connector and the mating contact is a male contact.

The shell 20 is made of a metal material and, as shown in FIG. 1, encloses an outer peripheral portion of the housing 10 and an outer peripheral portion of a portion protruding from a mounting portion 82 of the mating housing 80 in a mated state. The shell 20 establishes electrical continuity with the connection member 83 made of metal via the slide cam 30 made of metal, as will be described in greater detail below. Further, by grounding the shell 20 to the case of the device via the connection member 83, the electrical connector 1 and the mating connector 8 are electromagnetically shielded.

The components of the mating connector 8 will now be described in greater detail.

The mating housing 80 has a cylindrical housing main body 81 and the rectangular plate-like mounting portion 82 protruding radially outward from the housing main body 81 as shown in FIG. 2. The housing main body 81 has an engagement protrusion 81A engaging with a cam groove 30C of the slide cam 30. The engagement protrusion 81A protrudes from each of left and right sides of the housing main body 81.

As shown in FIG. 2, the connection member 83 is integrally provided with a fixation portion 831 fixed to a boss inside the case of the device and a rectangular lid portion 832 positioned along a surface of the case. The connection member 83 is formed integrally in a single piece from a suitable metal material. The lid portion 832 has a plurality of metal protrusions 833 protruding from the surface. The metal protrusions 833 are contacts for shielding which come into contact with an elastic portion of the slide cam 30, as described in greater detail below.

When the mating housing 80 and the connection member 83 are installed in the case of the device, the housing main body 81 is inserted into a hole in the fixation portion 831, and the fixation portion 831 is inserted into a hole for installation in the case. The lid portion 832 is positioned around the hole for installation. By inserting screws into fastener passageways 821 at four corners of the mounting portion 82 overlaid on the surface of the lid portion 832, and fixing the screws to the boss inside the case, the mating housing 80 and the connection member 83 are installed in the case. A terminal 81B connected to the male contact is connected to a terminal in the case. The plurality of metal protrusions 833 protruding from the lid portion 832 are inserted into individual holes formed in the mounting portions 82. The metal protrusions 833 protrude from a surface of the mounting portion 82. In other embodiments, the mounting portion 82 is not required to be inserted into the holes of the mounting portion 82.

The components of the electrical connector 1 will now be described in greater detail.

The housing 10, shown in FIG. 2, retains a female terminal connected to an electric wire W. The housing 10 is formed from an insulating resin material. A front end portion of the housing 10 is positioned inside the case of the device when the electrical connector 1 and the mating connector 8 are mated together.

The shell 20, as shown in FIG. 2, encloses the outer peripheral portion of the housing 10 on the whole, except for the front end portion of the housing 10. The shell 20 is formed by die casting from a metal material, such as an aluminum alloy or a zinc alloy. An outer peripheral portion of the shell 20 has a plurality of annular ribs. A rib located at a front end of the shell 20 is referred to as front ridge 20A and a rib located away to an extent equivalent to a width of the slide cam 30 from the front ridge 20A is referred to as rear ridge 20B.

The front ridge 20A, as shown in FIGS. 1 and 2, is notched at three locations corresponding to the plurality of metal protrusions 833, respectively, of the connection member 83. The metal protrusions 833 are positioned at the notched locations of the front ridge 20A. Therefore, when the slide cam 30 is positioned between the front ridge 20A and the rear ridge 20B, the metal protrusions 833 are located in the vicinity of a front end of the slide cam 30.

The front ridge 20A and the rear ridge 20B are coupled together via support rod portions 20C extending along the mating direction D1 as shown in FIG. 2. The slide cam 30 is inserted behind the support rod portions 20C and guided in a sliding direction D2 with the front ridge 20A and the rear ridge 20B. The support rod portion 20C is formed on each of right and left sides of the shell 20.

The slide cam 30 is slidable in the sliding direction D2 shown in FIG. 2 perpendicular to the mating direction D1 to the housing 10 and the shell 20 assembled with the housing 10. The term "perpendicular" herein encompasses a tolerance range of perpendicularity, namely, "substantially perpendicular", in addition to "perpendicular" in a strict sense. The slide cam 30 is slid between a start position shown in FIG. 2 and an end position shown in FIG. 1. When the slide cam 30 is slid to the end position shown in FIG. 1, the electrical connector 1 and the mating connector 8 are mated. At the mated state, the slide cam 30 is disposed between the front ridge 20A and the rear ridge 20B of the shell 20.

Figure 3A:
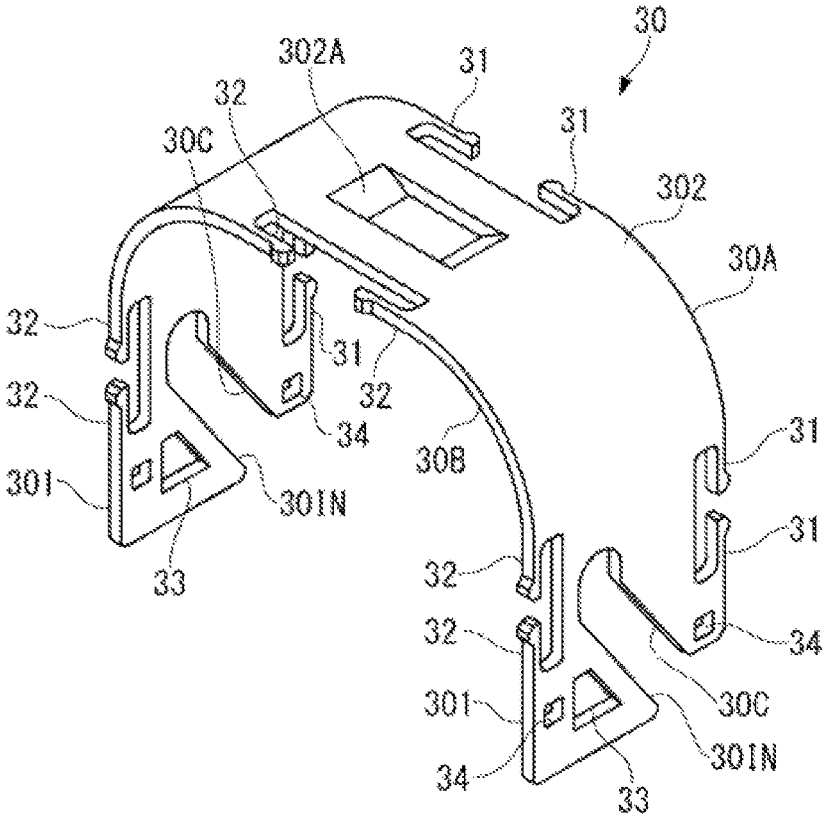
FIG. 3A is a perspective view of a slide cam of the electrical connector.
Figure 3B:
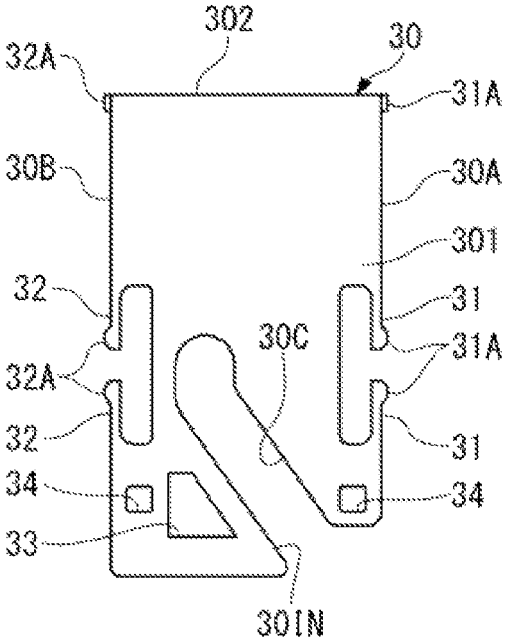
FIG. 3B is a side view of the slide cam.

The slide cam 30, as shown in FIGS. 3A and 3B, has a pair of side walls 301, 301 and a coupling wall 302 coupling the side walls 301, 301. The pair of side walls 301, 301 are positioned parallel to each other along the sliding direction D2 and the coupling wall 302 couples the side walls 301, 301 on an upper end side of the sliding direction D2. The slide cam 30, as shown in FIG. 1, encloses the outer peripheral portion of the shell 20 from three directions in FIG. 1: from above, from the left, and from the right. In another embodiment, the slide cam 30 may be formed in an annular shape as to connect lower ends of the side walls 301, 301 together.

The slide cam 30, as shown in FIGS. 3A and 3B, is integrally provided with a cam groove 30C, a front elastic portion 31, and a rear elastic portion 32. The front elastic portion 31 is located at a front end portion of the slide cam 30, and the rear elastic portion 32 is located at a rear end portion of the slide cam 30. The cam groove 30C is formed in each of the pair of side walls 301, 301. As shown in FIG. 3B, the cam groove 30C formed in the side wall 301 extends rearward and upward from an insertion opening 301N located at the lower end of the side wall 301. The insertion opening 30IN is opened frontward. The front elastic portion 31 is formed in all of the pair of side walls 301, 301 and the coupling wall 302. The rear elastic portion 32 is also formed in all of the pair of side walls 301, 301 and the coupling wall 302. As shown in FIG. 3A, a depression 302A is formed in a middle portion between the front elastic portion 31 and the rear elastic portion 32 of the coupling wall 302 in order to secure the rigidity of the coupling wall 302.

By depressing the slide cam 30, the engagement protrusion 81A is moved relatively obliquely upward in the cam groove 30C, as shown in FIG. 1, and the mating housing 80 is relatively drawn deep into the housing 10. The action of the cam groove 30C makes it possible to mate the housing 10 and the mating housing 80 with a small insertion force.

In the electrical connector 1, a metal material having elasticity is used to form the slide cam 30 and the elastic portions 31, 32 with which the slide cam 30 is integrally provided are used for electrical connection for electromagnetic shielding. The slide cam 30 is formed by bending and/or stamping from a sheet metal material having elasticity. The metal material having elasticity, for example, may include a stainless steel material, such as SUS 301, SUS 304, SUS 631, and the like.

Figure 5:
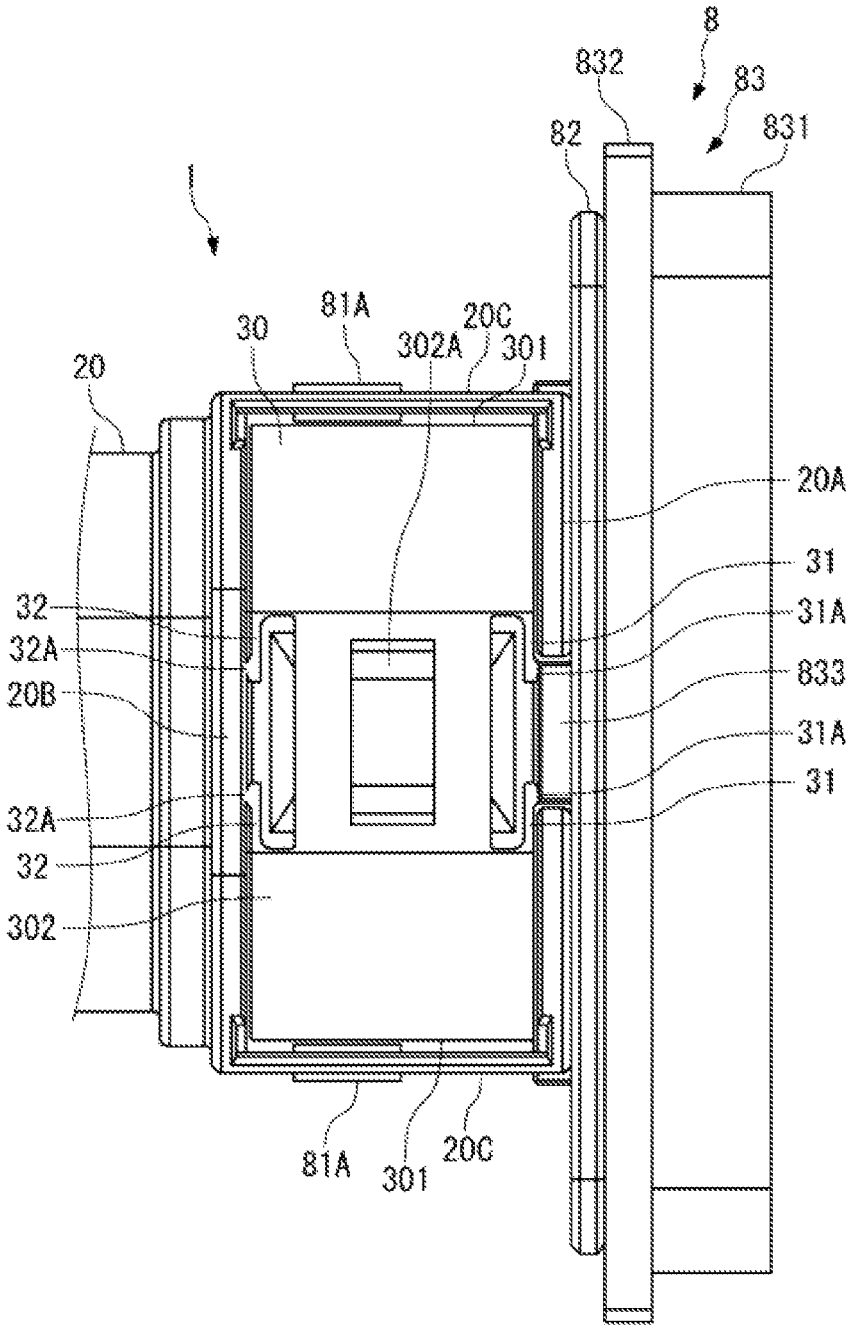
FIG. 5 is a top view of the electrical connector mated with the mating connector.

As shown in FIGS. 3B and 5, the front elastic portion 31 is a cantilevered leaf spring extending along the front end edge 30A from a support end connected to a front end edge 30A of the slide cam 30. Each side wall 301 has a pair of upper and lower symmetrical front elastic portions 31. The coupling wall 302, as shown in FIG. 3A, has a pair of left and right symmetrical front elastic portions 31. In a free state of the front elastic portion 31, a free end 31A is located in front of the front end edge 30A where the support end is located.

Figure 4:
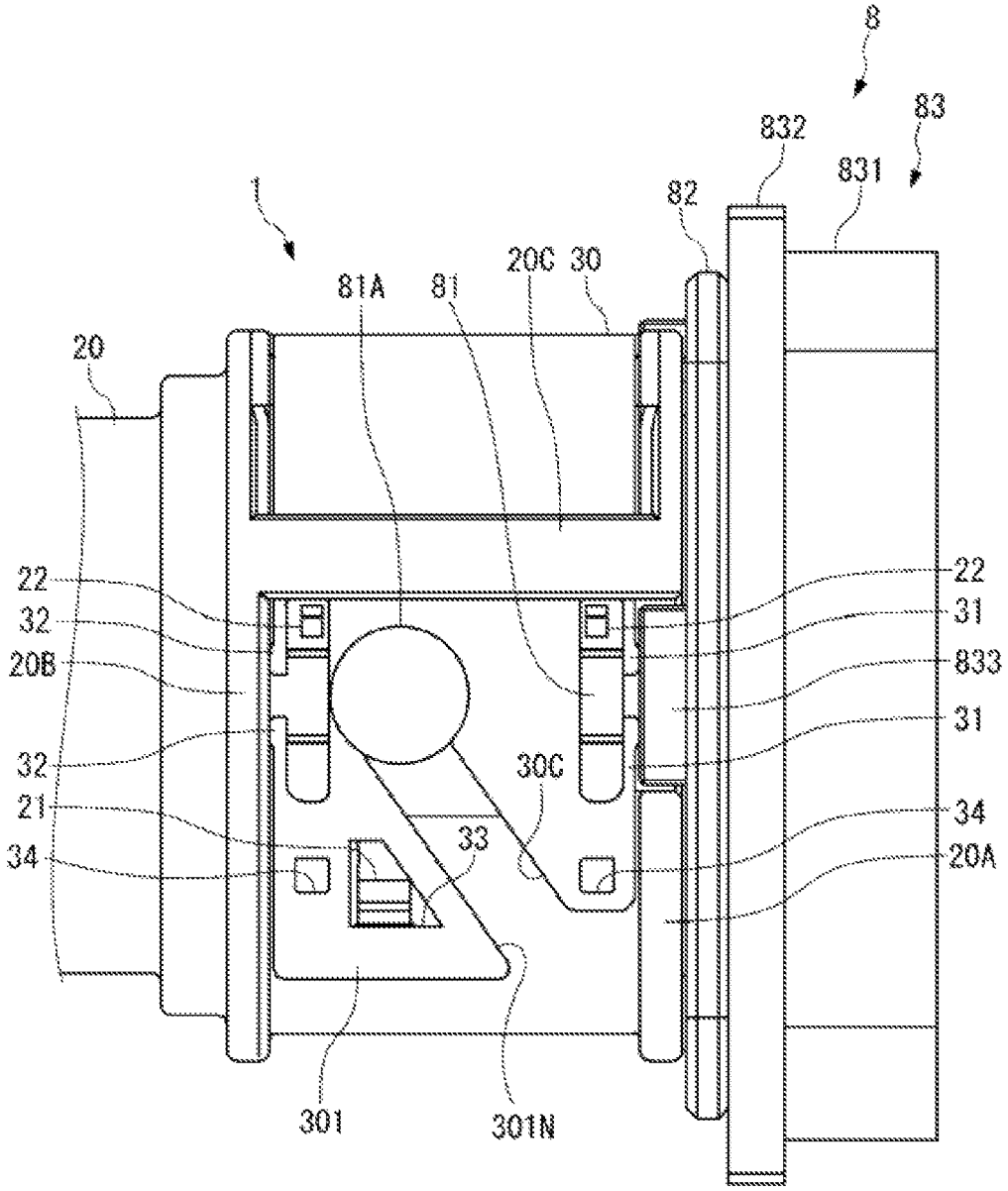
FIG. 4 is a side view of the electrical connector mated with the mating connector.

Each front elastic portion 31 is a contact for shielding coming into contact with the metal protrusion 833 of the connection member 83 of the mating connector 8 with predetermined contact pressure as shown in FIGS. 4 and 5. In an embodiment, the free end 31A circular profile as to be convex toward the metal protrusion 833.

The rear elastic portion 32 is similarly a cantilevered leaf spring extending along the rear end edge 30B from a support end connected to a rear end edge 30B of the slide cam 30 as shown in FIG. 3B. Each side wall 301 has a pair of upper and lower symmetrical rear elastic portions 32. The coupling wall 302 has a pair of left and right symmetrical rear elastic portions 32. In a free state of the rear elastic portion 32, a free end 32A is located behind the rear end edge 30B where the support end is located.

Each rear elastic portion 32 is a contact for shielding coming into contact with the rear ridge 20B of the shell 20 with predetermined contact pressure, as shown in FIGS. 4 and 5. In an embodiment, the free end 32A has a circular profile as to be convex toward the rear ridge 20B.

In the shown embodiment, all of the front elastic portions 31 individually formed in the side walls 301, 301 and the coupling wall 302 are equal in length from the support ends to the free ends 31A. The same applies to the rear elastic portion 32.

Since the metal protrusion 833 contacting the front elastic portion 31 are located in the vicinity of the front end portion of the slide cam 30 where the front elastic portion 31 is located, it is possible to ensure that the front elastic portion 31 is brought into contact with the metal protrusion 833 while reducing the size of the front elastic portion 31. The same applies to the rear elastic portion 32. Since the rear ridge 20B contacting the rear elastic portion 32 is located in the vicinity of the rear end portion of the slide cam 30 where the rear elastic portion 32 is located, it is possible to ensure that the rear elastic portion 32 is brought into contact with the rear ridge 20B while reducing the size of the rear elastic portion 32.

The use of the electrical connector 1 and the mating connector 8 will now be described in greater detail with reference to FIGS. 6A-7.

Figure 6A:
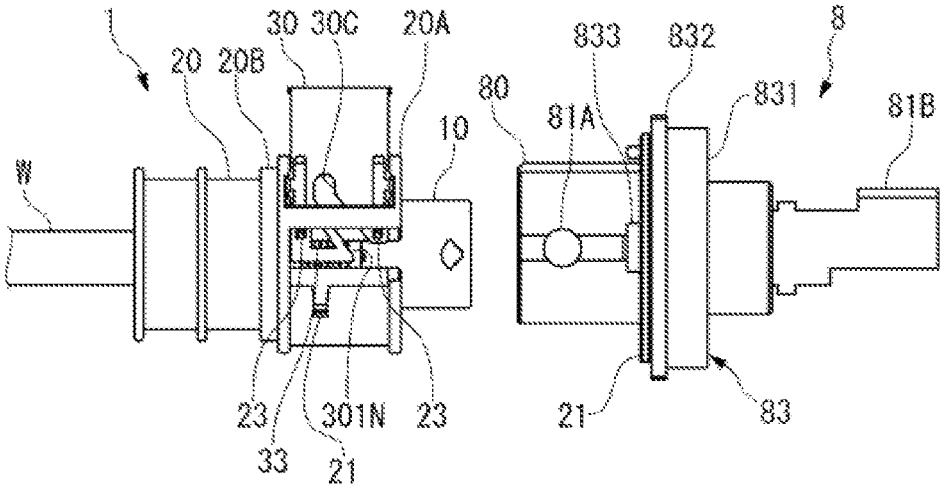
FIG. 6A is a side view of the electrical connector and the mating connector separated from each other.

As shown in FIG. 6A, when the electrical connector 1 and the mating connector 8 are separated, the slide cam 30 is located in a start position. At this time, a protrusion 22 of the shell 20 is inserted into an engagement hole 34 formed in the side wall 301 shown in FIG. 3B. Such engagement of the hole 34 and the protrusion 22 determines the position of the slide cam 30 relative to the shell 20 in the start position.

As shown in FIG. 6A and FIG. 2, when the slide cam 30 is in the start position, the front elastic portions 31 and the rear elastic portions 32 located in the side wall 301 are disengaged from between the front ridge 20A and the rear ridge 20B of the shell 20. Accordingly, none of the front elastic portions 31 nor rear elastic portions 32, including the front elastic portion 31 and the rear elastic portion 32 located in the coupling wall 302, are elastically deformed.

Figure 6B:
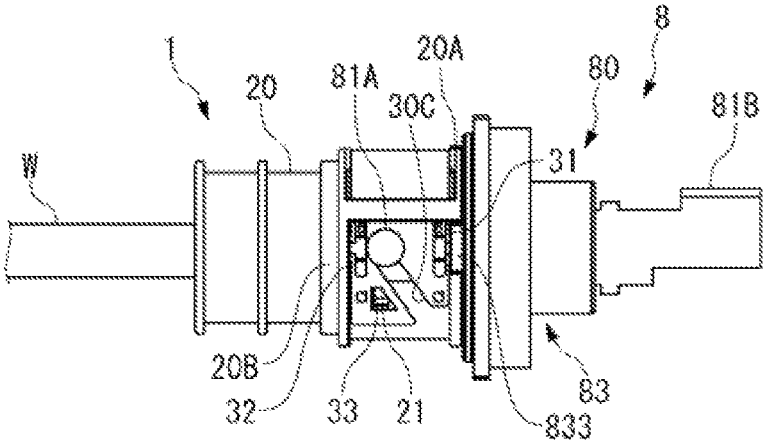
FIG. 6B is a side view of the electrical connector mated with the mating connector.

When the housing 10 of the electrical connector 1 is received inside the mating housing 80 from the state shown in FIG. 6A, the engagement protrusion 81A is located in the insertion opening 30IN of the cam groove 30C of the slide cam 30. Then, as the slide cam 30 is depressed, the mating housing 80 is relatively drawn in the mating direction D1 while the engagement protrusion 81A is guided by the cam groove 30C. As shown in FIG. 6B, the slide cam 30 is slid until the engagement protrusion 81A reaches a dead end of the cam groove 30C opposite the insertion opening 30IN. Thereupon, the housing 10 and the mating housing 8 are completely mated, and the slide cam 30 is accommodated between the front ridge 20A and the rear ridge 20B. A protrusion 21 of the shell 20 is inserted into an engagement hole 33 of the slide cam 30 shown in FIG. 4, holding the slide cam 30 is an end position.

When the slide cam 30 reaches the end position, as shown in FIGS. 4 and 5, the front elastic portion 31 is depressed and deflected by the metal protrusion 833 and the rear elastic portion 32 is depressed and deflected by the rear ridge 20B. Thereupon, the front elastic portion 31 is pressed in the mating direction D1 to the metal protrusion 833, and the rear elastic portion 32 is pressed in the mating direction D1 to the rear ridge 20B. The front elastic portion 31 and the rear elastic portion 32 easily elastically deform in the mating direction D1 perpendicular to the sliding direction D2, and are pressed against the metal protrusion 833 and the rear ridge 20B, respectively, with elastic force. Both the front elastic portions 31 and the rear elastic portions 32 individually formed in the side walls 301, 301 and the coupling wall 302 are positioned between the front ridge 20A and the rear ridge 20B, and pressed in the mating direction D1 against the metal protrusion 833 and the rear ridge 20B.

When the electrical connector 1 and the mating connector 8 are completely mated by sliding the slide cam 30 to the end position, the housing 10 and the portion of the mating housing 80 protruding from the case are covered on the whole with the shell 20 and the connection member 83. In addition, the shell 20 of the electrical connector 1 and the connection member 83 of the mating connector 8 are electrically connected via the slide cam 30 made of metal, and therefore, the electrical connector 1 and the mating connector 8 are completely electromagnetically shielded. Both the front elastic portions 31 and the rear elastic portions 32 are distributed without being unevenly located in space. By the plurality of front elastic portions 31 and the plurality of rear elastic portions 32, electrical connection for electromagnetic shielding is sufficiently established. Therefore, electromagnetic noise interference can be sufficiently reduced.

The slide cam 3 is formed from a metal material having elasticity as a separate component from the shell 20 molded by die casting. Therefore, the elastic portions 31, 32 that are shield contacts can be integrated with the slide cam 30, so that a separate member dedicated for a shield contact is not required. Further, the small front elastic portion 31 and rear elastic portion 32 elastically deforming in a direction perpendicular to the sliding direction D2 are well-fitted in between the front ridge 20A and the rear ridge 20B, and accordingly contribute to a size reduction of the electrical connector 1.

The front elastic portion 31 and the rear elastic portion 32 do not elastically deform in an initial stage of mating and only elastically deform in the end of the mating process. Therefore, coincidence of the time when the terminals come into contact with each other and the time when the front elastic portion 31 and the rear elastic portion 32 that are shield contacts come into contact with the metal protrusion 833 and the rear ridge 20B, respectively, can be avoided. Consequently, a temporary sharp rise in necessary insertion force during mating is prevented.

Figure 7:
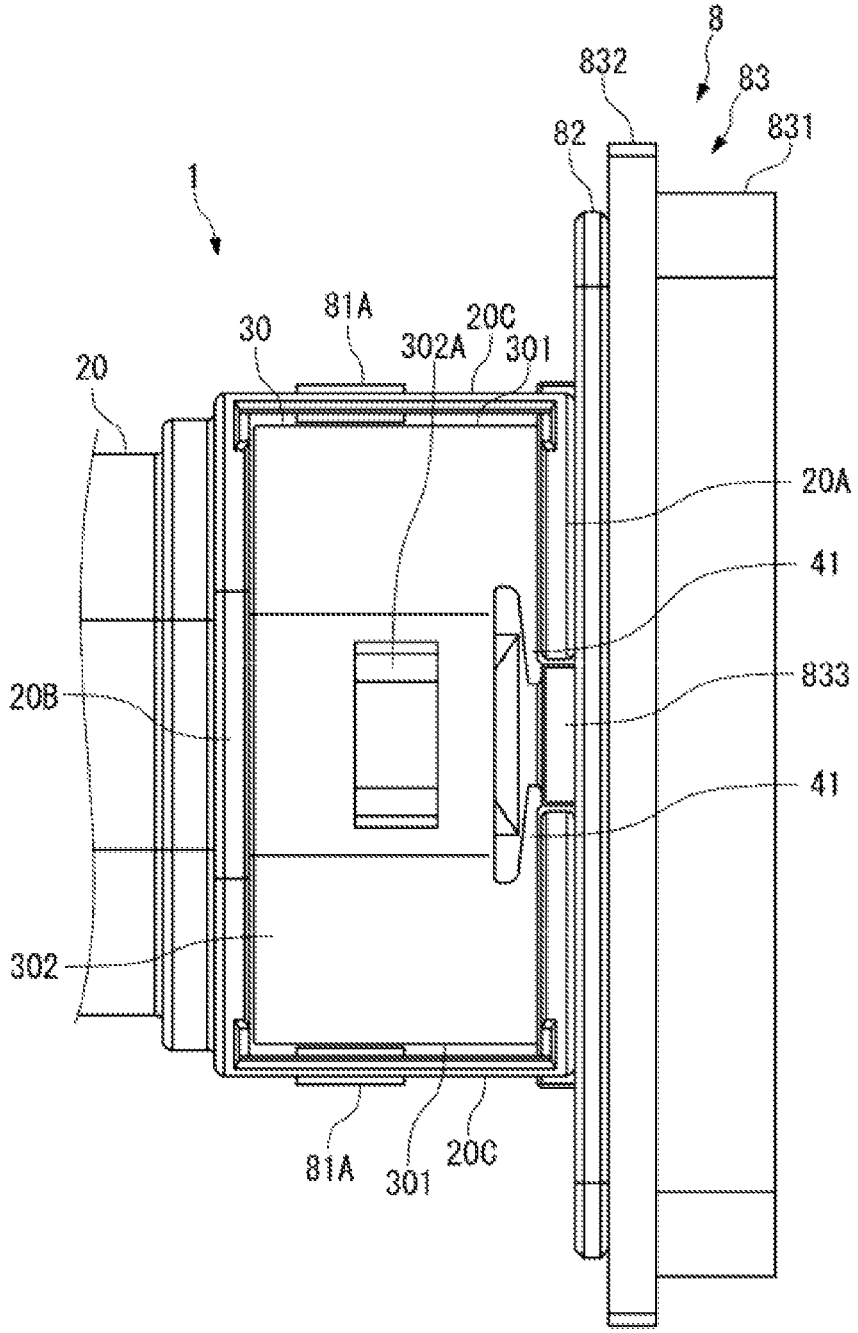
FIG. 7 is a top view of an electrical connector according to another embodiment with a mating connector.

An electrical connector 1 according to another embodiment is shown in FIG. 7. Like reference numbers refer to like elements and only the differences from the embodiment shown in FIGS. 1-6 will be described in detail herein. A front elastic portion 41 of the slide cam 3 in FIG. 7 has a different shape and/or length from the front elastic portion 31 shown in FIG. 5. The front elastic portion 41 is pressed with both the metal protrusion 833 of the connection member 83 and the front ridge 20A of the shell 20 on the front end side of the slide cam 30. That is, the front elastic portion 41 doubles as the front elastic portion 31 of the above embodiment coming into contact with the connection member 83 and the rear elastic portion 32 of the above embodiment coming into contact with the shell 20. Since the front elastic portion 41 comes into contact with the shell 20, the rear elastic portion 32 of FIG. 5 is not required in the embodiment of FIG. 7.

In an embodiment, the mating connector 8 has a shell made of metal and enclosing the mating housing 80, and the shell is grounded to the case of the device, or the like. The front elastic portions 31, 41 of the slide cam 30 can also be configured to be pressed against a predetermined region of the shell of the mating connector 8.

In other embodiments, the front elastic portion 31 and the rear elastic portion 32 of the slide cam 30 are not necessarily required to come into contact with the connection member 83 and the shell 20, respectively, near the slide cam 30. The front elastic portion 31 located in the coupling wall 302 may also be configured to come into contact with a flat portion of the lid portion 832 of the connection member 83 from above the front ridge 20A and beyond the front ridge 20A.

What is claimed is:

1. An electrical connector, comprising:

a housing configured to be mated with a mating connector along a mating direction;

a shell made of a metal material and enclosing the housing and electromagnetically shielding the housing; and a slide cam made of a metal material and slidable with respect to the housing and the shell in a sliding direction perpendicular to the mating direction, the slide cam having:

a cam portion guiding the mating connector along the mating direction;

a first elastic portion configured to be connected with a metal region of the mating connector electrically;

a second elastic portion configured to be connected with a rear ridge of the shell electrically; and the first and the second elastic portions integrally formed in a single piece with the cam portion.

2. The electrical connector of claim 1, wherein the first elastic portion is disposed at a front end portion of the slide cam and the second elastic portion is disposed at a rear end portion of the slide cam.

3. The electrical connector of claim 2, wherein the first elastic portion and the second elastic portion are both positioned between the metal region and the predetermined region of the shell.

4. The electrical connector of claim 3, wherein the metal region is disposed in front of the slide cam and the predetermined region of the shell is disposed behind the slide cam in the mating direction.

5. The electrical connector of claim 2, wherein the slide cam has a pair of side walls extending in the sliding direction along an outer peripheral portion of the shell.

6. The electrical connector of claim 5, wherein the slide cam has a coupling wall coupling the pair of side walls at an end of the side walls in the sliding direction.

7. The electrical connector of claim 6, wherein the first elastic portion is disposed in each of the pair of side walls and the coupling wall.

8. The electrical connector of claim 7, wherein the second elastic portion is disposed in each of the pair of side walls and the coupling wall.

9. The electrical connector of claim 8, wherein the coupling wall has a depression between the first elastic portion and the second elastic portion.

10. The electrical connector of claim 8, wherein the first elastic portion is a cantilevered leaf spring extending along a front end edge of the front end portion of the slide cam.

11. The electrical connector of claim 10, wherein the second elastic portion is a cantilevered leaf spring extending along a rear end edge of the rear end portion of the slide cam.

12. The electrical connector of claim 11, wherein each of the pair of side walls and the coupling wall has a pair of symmetrical first elastic portions and a pair of symmetrical second elastic portions.

13. The electrical connector of claim 11, wherein a free end of the first elastic portion is disposed in front of the front end edge in a non-deformed state of the first elastic portion.

14. The electrical connector of claim 13, wherein a free end of the second elastic portion is disposed behind the rear end edge in a non-deformed state of the second elastic portion.

15. The electrical connector of claim 13, wherein the free end of the first elastic portion has a circular profile which is convex toward the metal region.

16. The electrical connector of claim 14, wherein the free end of the second elastic portion has a circular profile which is convex toward the predetermined region of the shell.

17. The electrical connector of claim 1, wherein the slide cam is slidable with respect to the housing and the shell between a start position and an end position, a first protrusion of the shell engaging a first engagement hole of the slide cam in the start position and a second protrusion of the shell engaging a second engagement hole of the slide cam in the end position.

18. An electrical connector, comprising:

a housing configured to be mated with a mating connector along a mating direction;

a shell made of a metal material and enclosing the housing and electromagnetically shielding the housing; and a slide cam made of a metal material and slidable with respect to the housing and the shell in a sliding direction perpendicular to the mating direction, the slide cam having:

a cam portion guiding the mating connector along the mating direction; and an elastic portion integrally formed in a single piece with the cam portion and configured to be connected against both a metal region of the mating connector and a predetermined region of the shell electrically.

19. The electrical connector of claim 18, wherein the elastic portion is disposed at a front end portion of the slide cam.

20. The electrical connector of claim 19, wherein the metal region is disposed in front of the slide cam and the predetermined region of the shell is disposed in front of the slide cam in the mating direction.

* * * * *